United States Patent [19]

Heitmann et al.

[11] Patent Number: 4,736,754

[45] Date of Patent: Apr. 12, 1988

[54] METHOD AND APPARATUS FOR MAKING ROD-SHAPED SMOKERS' PRODUCTS WITH SOFT CORES

[75] Inventors: Uwe Heitmann, Hamburg; Heinz-Christen Lorenzen, Wentorf; Wolfgang Steiniger, Börnsen, all of Fed. Rep. of Germany

[73] Assignee: Hauni-Werke Körber & Co. K.G., Hamburg, Fed. Rep. of Germany

[21] Appl. No.: 660,431

[22] Filed: Oct. 11, 1984

[30] Foreign Application Priority Data

Oct. 12, 1983 [DE] Fed. Rep. of Germany ..... 3337035

[51] Int. Cl.[4] ..... A24C 5/18

[52] U.S. Cl. ..... 131/84.3; 131/364

[58] Field of Search ..... 131/84 B, 84.1, 84.2, 131/84.3, 84.4, 364

[56] References Cited

U.S. PATENT DOCUMENTS 4,185,644 1/1980 Heitmann et al. ..... 131/109.1

FOREIGN PATENT DOCUMENTS 1164907 5/1964 Fed. Rep. of Germany .

1338546 8/1963 France ..... 131/84 B 1086443 10/1967 United Kingdom .

*Primary Examiner*—Vincent Millin

*Attorney, Agent, or Firm*—Peter K. Kontler

[57] ABSTRACT

A rod-like filler for the making of a cigarette rod is obtained by showering particles of tobacco onto a foraminous belt conveyor which is located in front of a suction chamber and is flanked by two additional foraminous belt conveyors or by two stationary sidewalls so that the particles form a thin layer having a substantially U-shaped cross-sectional outline with a centrally located web and two legs. The legs are thereupon moved toward each other to convert the layer into a tube having a relatively soft core or a centrally located channel which is devoid of tobacco, and the filler is then draped into a web of cigarette paper and simultaneously densified to reduce its cross section to that of a cigarette before the resulting cigarette rod is subdivided into discrete cigarettes of desired length. The thickness of the layer is a fraction of its width. The sidewalls and/or a mandrel which keeps the center of the filler free of tobacco particles can admit into the layer hot air, moisture-laden air and/or volatile flavoring agents prior to conversion of the layer into a rod-like filler.

61 Claims, 5 Drawing Sheets a1
a2
b1
b2
c1
c2
Z1
Z2
Z3
Z4
P
204
207
208
209
211
212
216
217.1
217.2
217.3
218
219
221
224
226
228
281
281a
206
306
316
319
319a
321
321a
381
382
382a
383
404
406
416
419
419a
421
421a
481
482
483
486
487
487a
487b
487c
487d
487e
487f
487g
488

METHOD AND APPARATUS FOR MAKING ROD-SHAPED SMOKERS' PRODUCTS WITH SOFT CORES

CROSS-REFERENCE TO RELATED CASES

Certain details of the apparatus which are disclosed in the present application are similar to those of apparatus which are described and shown in commonly owned copending patent applications Ser. Nos. 557,641 (filed Dec. 2, 1983 by Heitmann) now U.S. Pat. No. 4,610,260, 557,733 (filed Dec. 2, 1983 by Wahle et al.) now U.S. Pat. No. 4,593,704, 557,735 (filed Dec. 2, 1983 by Wahle et al.) now U.S. Pat. No. 4,564,026 and 572,564 (filed Jan. 18, 1984 by Wahle et al.) now U.S. Pat. No. 4,580,579. Reference may also be had to the commonly owned copending patent application Ser. No. 660,430 filed on even date.

BACKGROUND OF THE INVENTION

The present invention relates to improvements in rod-shaped smokers' articles in general, and more particularly to improvements in rod-shaped articles of the type having a relatively soft or non-existent core and a relatively dense outer layer of smokable particulate material. The invention also relates to a novel method and to a novel apparatus for the making of such articles.

German Pat. No. 11 64 907 discloses a cigarette which has a centrally extending air-conveying channel. The channel is formed by a stationary mandrel which extends axially through the rod-shaped filler of the cigarette. The mandrel continuously discharges into the particles of smokable material a hardening agent which is supposed to ensure that the channel will remain intact upon extraction of the mandrel.

A cigarette which has an axially extending channel or a core of relatively low density (as compared with the density of the surrounding outer layer) is disclosed in British Pat. No. 1,086,443.

OBJECTS AND SUMMARY OF THE INVENTION

An object of the invention is to provide a novel and improved method of making rod-shaped smokers' articles having centrally located channels or central portions whose density is lower than that of the surrounding layers.

Another object of the invention is to provide a smokers' article which is produced in accordance with the above outlined method.

A further object of the invention is to provide a novel and improved apparatus for practice of the above method and for the making of the above outlined rod-shaped smokers' articles.

An additional object of the invention is to provide an apparatus which can influence the characteristics of the material of the fillers of rod-shaped smokers' articles in a number of beneficial ways.

Still another object of the invention is to provide a trimming device which can be used in the above outlined apparatus to perform its accustomed function as well as an entirely different function which contributes to predictable formation of rod-shaped fillers for the making of cigarette rods or the like.

A further object of the invention is to provide an apparatus which can turn out articles of the above outlined character at the same rate at which a modern cigarette rod making machine turns out rod-shaped articles having a constant density throughout the entire filler or wherein the density is increased at the one or the other longitudinal end of the filler.

Another object of the invention is to provide novel and improved means for ensuring that the particles of smokable material will advance through the apparatus with a minimum of friction and without undesirable comminution during conversion into the fillers of rod-shaped smokers' articles.

An additional object of the invention is to provide an apparatus which can produce cigarettes or other rod-shaped smokers' articles of satisfactory firmness with smaller quantities of smokable material than the heretofore known apparatus.

One feature of the invention resides in the provision of a method of forming a rod-like filler from particles of smokable material. The method comprises the steps of accumulating the particles into an elongated layer having a thickness which is a fraction of its width, advancing the layer lengthwise along a predetermined path, and converting the advancing layer into a rod-like filler having a central portion or core of lesser density and an outer layer or shell of greater density. The accumulating step preferably includes showering the particles into the path and pneumatically retaining at least some of the particles in the path. Such retaining step can include placing into the path a foraminous belt conveyor and evacuating air from one side of the conveyor. The showering step includes delivering particles of smokable material to the other side of the conveyor in the predetermined path. The accumulating step preferably further includes imparting to the layer a substantially U-shaped cross-sectional outline with a centrally located longitudinally extending web and two flanges or legs flanking the web. The particles are deposited at the other side of the conveyor to thus form the web of the layer, and the particles which form the legs are deposited thereafter laterally adjacent to the conveyor, preferably in such a way that the particles which form one of the legs are deposited prior to deposition of particles which form the other leg. The legs of the U-shaped layer can be mechanically entrained along the path, e.g., by placing a pair of additional foraminous conveyors along the marginal portions of the belt conveyor and pneumatically holding the particles which form the legs on the additional conveyors. Alternatively, the legs of the U-shaped layer can be entrained along stationary sidewalls which flank and extend beyond the other side of the belt conveyor. Under such circumstances, the method preferably further comprises the step of reducing friction between the sidewalls and the legs of the layer in the predetermined path, e.g., by admitting a gaseous fluid medium between the sidewalls and the respective legs of the layer and/or by vibrating the sidewalls, preferably at a frequency in the ultrasonic range.

The foraminous belt conveyor and the sidewalls or the additional conveyors can be said to constitute component parts of a trough-shaped transporting unit. The sidewalls can constitute means for admitting into the layer one or more flavoring agents, especially highly volatile flavoring agents, in order to ensure that such agents will not escape or that only a small percentage of such agents will escape before the filler is draped into a web of cigarette paper or the like. The method can also comprise the step of admitting into the layer a hot gaseous fluid (e.g., air) in order to reduce friction between the sidewalls and the adjacent legs of the U-shaped layer and/or to enhance other characteristics and/or to promote the distribution of flavoring agent or agents in the material of the layer. Still further, the method can comprise the step of admitting moisture (e.g., water or water vapors) into the layer by way of the sidewalls, preferably in such quantities that the moisture contacts the particles at the adjacent side of the layer but not at the opposite side.

The converting step preferably includes moving the legs of the layer toward each other to thus transform the layer into the rod-like filler. Such moving step can include mechanically engaging those portions of the legs which are remote from the web and moving the thus engaged portions of the legs nearer to each other. For example, the aforementioned remote portions of the legs can be contacted by two rotating discs and the method can further comprise the step of removing the particles which extend beyond the discs in a direction away from the one side of the web.

The particles which are about to form the web of the layer can be showered at an elevated speed (e.g., under the action of a stream of compressed air) and at an oblique angle to the direction of advancement of the layer along the predetermined path. The particles which are about to form the legs can be showered at an elevated speed and in substantial parallelism with the direction of advancement of the layer along the predetermined path.

The rod-like filler is thereupon transferred onto a running web of wrapping material (e.g., cigarette paper) and the wrapping material is draped around the filler. The filler is preferably densified not later than in the course of the draping step.

In accordance with a modification of the above outlined method, a U-shaped first layer can be formed by showering particles of smokable material onto a flat belt conveyor and the resulting layer is thereupon converted into a concavo-convex second layer by bending the conveyor into the shape of a gutter or trough. Such second layer is then transferred onto a web of wrapping material which is also converted into a trough-shaped body and the second layer within the trough-shaped web is thereupon condensed from within (e.g., by resorting to a suitably bent mandrel) so that the diameter of the condensed layer matches that of a cigarette or another rod-shaped smokers' article before the draping of the web is completed and the overlapping marginal portions of the web are bonded to each other.

It is further within the purview of the invention to prevent the penetration of particles into the space between the legs of the U-shaped layer at one side of the web, e.g., by utilizing a stationary mandrel which is adjacent to the predetermined path and at least substantially fills the just mentioned space. The method then preferably further comprises the step of reducing friction between the mandrel and the adjacent particles of the layer, e.g., by introducing a gaseous fluid medium between the mandrel and the layer and/or by vibrating the mandrel (preferably at a frequency in the ultrasonic range). The flavoring agent or agents can be admitted into the layer by way of the mandrel, the same as a hot gaseous fluid and/or moisture (preferably in such quantities that it contacts only the particles at the adjacent side of the layer but not those particles which are disposed at the opposite side.

Another feature of the invention resides in the provision of an apparatus for forming a rod-shaped filler from particles of smokable material including natural tabocco, substitute tobacco and/or reconstituted tobacco. The apparatus comprises a transporting unit which defines an elongated preferably (but not necessarily) horizontal path, means for supplying particles of smokable material into a portion of the path so as to form an elongated layer which advances lengthwise along the path and whose thickness is a fraction of its width, and means for converting the layer in the path into a rod-like filler with a central portion or core of lesser (e.g., zero) density and an outer layer or shell of greater density. The transporting unit preferably includes a foraminous belt conveyor having a first side which faces the path and a second side, and means (e.g., an elongated stationary suction chamber) for evacuating air from the second side of the belt conveyor. The supplying means of such apparatus includes means for delivering particles of smokable material to the first side of the belt conveyor. The transporting unit can constitute a substantially trough- or gutter-shaped body which surrounds three sides of the elongated path and the supplying means can include means for delivering particles of smokable material to all three sides of such path so that the layer has a substantially U-shaped cross-sectional outline with a centrally located longitudinally extending web and two flanges or legs extending from one side of and flanking the web. The first side of the aforementioned foraminous belt conveyor is adjacent to the web of the layer. The supplying means can comprise a first device or section which delivers particles to form the web and at least one second device which delivers particles to form the legs of the layer in the path. It is presently preferred to assemble the supplying means of a first device which delivers particles to form the web in a first step, a second device which supplies particles to form one of the legs in a second step, and a third device which delivers particles to form the other leg in a subsequent third step so that the web, the one leg and the other leg are formed one after the other rather than simultaneously. The body of the transporting unit can further comprise two additional belt conveyors which flank and extend beyond the first side of the foraminous belt conveyor. Such additional conveyors are preferably permeable to air and the transporting unit then further comprises additional suction chambers which are outwardly adjacent to the additional conveyors to attract the respective legs of the layer thereto.

Alternatively, the transporting unit can comprise two stationary sidewalls which are adjacent to the marginal portions of and extend from the one side of the foraminous belt conveyor. Such apparatus then preferably further comprises means for reducing friction between the sidewalls and the respective legs. The friction reducing means can comprise at least one source of compressed gaseous fluid (e.g., air), and the sidewalls then comprise openings which are connected to such source or sources and serve to admit gaseous fluid between the sidewalls and the adjacent legs of the layer in the path. Alternatively, or in addition to such source or sources of gaseous fluid, the friction reducing means can comprise means for vibrating the sidewalls, preferably at a frequency in the ultrasonic range. Still further, the apparatus can comprise at least one source of (normally volatile or highly volatile) flavoring agent for the particles of smokable material and means for admitting the flavoring agent or agents into the layer by way of the sidewalls. Also, the apparatus can comprise a source of heated gaseous fluid (e.g., air at a temperature of approximately 40° C.) and means for admitting the heated fluid into the layer by way of the sidewalls. Still further, the apparatus can comprise a source of moisturized gaseous fluid (e.g., air which contains water vapors) and means for admitting moisturized fluid into the layer by way of the sidewalls, preferably at a rate such that the moisture comes in contact with the particles which are immediately adjacent to the sidewalls but not with the particles which are remote therefrom.

The apparatus can further comprise a stationary mandrel which is adjacent to the path and is configurated in such a way that it is spaced apart from all three sides of the path (i.e., that it provides room for the passage of a layer having a substantially U-shaped cross-sectional outline). Such apparatus preferably further comprises means for reducing friction between the mandrel and the adjacent particles of the layer. Such friction reducing means can be analogous to those described above in connection with the stationary sidewalls, and the same applies for the admission of hot gaseous fluid, one or more flavoring agents and/or moisture-containing gases into the layer by way of the mandrel.

The converting means can comprise means for draping the rod-like filler into a web of cigarette paper or other suitable wrapping material, and the mandrel preferably terminates in the range of such draping means.

The converting means can constitute or comprise a trimming or equalizing device having mobile deforming means serving to engage portions of the legs at a location which is remote from the web of the layer and to move such portions of the legs nearer to each other so as to impart to the layer a substantially tubular cross-sectional outline. The deforming means can comprise two rotary discs driven at peripheral speeds which approach or match the speed of lengthwise movement of the layer along its path. Such apparatus (and more particularly the trimming device) can further comprise a rotary brush or a paddle wheel serving as a means for removing from the layer those particles of smokable material which extend beyond the discs in a direction away from the web of the layer in the path.

As a rule, the converting means will comprise means (such as the aforementioned draping means) for condensing the filler so that the cross-sectional outline of the filler is reduced to match or approximate that of a cigarette or another rod-shaped smokers' article.

In accordance with a further embodiment of the apparatus, the transporting unit comprises an elongated flat conveyor defining a portion of the aforementioned path and the supplying means includes means for depositing particles of smokable material at one side of the conveyor so that the thus obtained layer exhibits a substantially U-shaped cross-sectional outline (with two preferably short legs, as considered at right angles to the direction of movement of the layer along its path) with a centrally located and longitudinally extending web which is flanked by the two legs. The marginal portions of such legs are remote from the web and the converting means of such apparatus comprises means for moving the marginal portions of the conveyor and hence the marginal portions of the legs nearer to each other. Such apparatus further comprises a source of web-shaped wrapping material (e.g., a bobbin or reel of convoluted cigarette paper), means for advancing the wrapping material from the source into the path and for draping the wrapping material around the layer which is transferred onto the wrapping material by the aforementioned conveyor, means for imparting to the wrapping material the shape of a trough not later than in the region of transfer of the layer onto the wrapping material, and means for densifying the draped layer including a stationary mandrel which extends into the layer downstream of the aforementioned region so that the cross-sectional outline of the densified layer resembles or matches that of a rod-shaped smokers' article.

An additional feature of the invention resides in the provision of a novel article of manufacture which is a rod-shaped smokers' article having a rod-like filler with a lower-density central portion or core and a higher-density outer layer or shell. The filler constitutes a converted single layer of particles consisting of smokable material and the article further comprises a tubular wrapper which surrounds the periphery of the filler.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
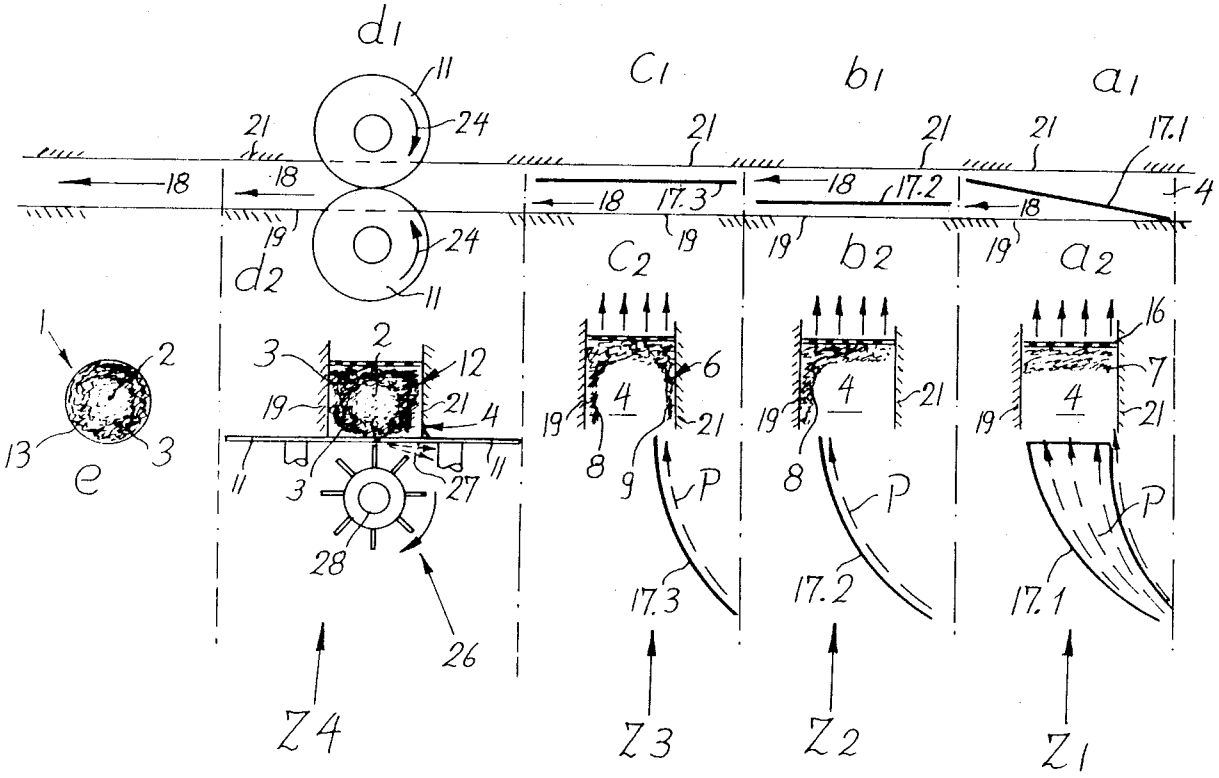
FIG. 1 is a diagrammatic bottom plan view of a portion of a cigarette rod making machine embodying an apparatus which is constructed and assembled in accordance with a first embodiment of the invention, five different stages of the formation of a rod-shaped article being shown in sectional views below the corresponding portions of the apparatus.

FIG. 1 shows diagrammatically a portion of a cigarette rod making machine which employs an apparatus embodying one form of the invention and serving to form a wrapped tobacco rod 1 with a rod-like filler including a relatively soft central portion or core 2 and a denser tubular outer layer or shell 3 (as shown at e in the left-hand portion of FIG. 1).

The apparatus comprises a transporting unit 4 which is an elongated body having a substantially U-shaped cross-sectional outline, and means for supplying to the unit 4 particles P of smokable material (e.g., tobacco shreds, shreds of reconstituted tobacco and/or shreds of substitute tobacco) in such a way that the supplied particles P form an elongated layer 6 having a thickness (as considered at right angles to the direction (arrow 18) of advancement of the layer 6 with the mobile part or parts of the transporting unit 4) which is a relatively small fraction of the width of the layer. The particles P are preferably showered from below by three devices or sections of the showering means, namely a first device which operates in the zone Z1 of FIG. 1 and forms the centrally located longitudinally extending web 7 of the layer 6, a second device which operates in the zone Z2 of FIG. 1 and forms one (8) of the two flanges or legs 8, 9 of the layer 6, and a third device which operates in the zone Z3 of FIG. 1 and forms the other flange or leg 9. The legs 8 and 9 extend downwardly beyond the underside of the web 7 and flank the latter so that the finished layer 6 has a substantially U-shaped cross-sectional outline and its three components 7, 8 and 9 are adjacent to three different sides of the elongated horizontal or substantially horizontal path which is defined by the body of the transporting unit 4.

The thus obtained trough- or gutter-shaped layer 6 is thereupon converted into a rod-like filler 12 by a trimming or equalizing device 26 which is disposed in the zone Z4 of FIG. 1 and includes mobile layer deforming means in the form of two rotary disc-shaped members 11 rotating in the directions indicated by arrows 24 and serving to engage those portions of the legs 8 and 9 which are remote from the web 7. The filler 12 has the aforementioned soft (less dense) core or central portion 2 and the denser outer layer or shell 3. The machine which embodies the apparatus of FIG. 1 further includes a draping mechanism 66 (see FIG. 2) wherein the filler 12 is densified and reshaped so that its cross-sectional outline matches or approximates that of a cigarette, and the densified filler 12 is then draped into a web 13 of cigarette paper or other suitable wrapping material which results in the making of a continuous wrapped tobacco rod 1 of the type shown in FIG. 1 at e and also in the left-hand portion of FIG. 2. The rod 1 is thereupon severed by a cutoff 69 to yield a succession of discrete rod-shaped smokers' articles of unit length or multiple unit length. It has been found that, in spite of pronounced densification of the filler 12 during travel through the draping mechanism 66, the ratio of densities of the central portion 2 and outer layer 3 remains unchanged or does not change appreciably, i.e., the density of the central portion of the filler in the wrapped tobacco rod 1 is still much less pronounced than the density of the outer layer 3. Thus, the rod-shaped articles (e.g., cigarettes) which are formed by the cutoff 69 as a result of repeated severing of the leader of the rod 1 also comprise fillers with softer central portions and denser outer layers.

Figure 3:
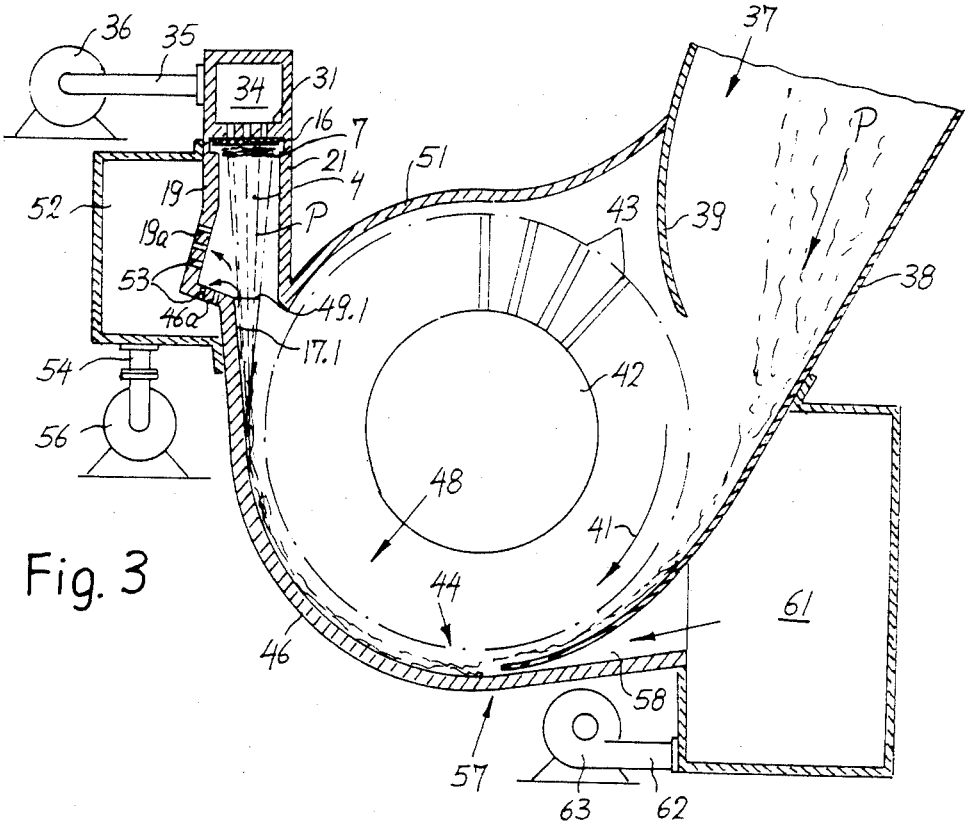
FIG. 3 is an enlarged transverse sectional view as seen in the direction of arrows from the line III—III of FIG. 2.

The making of the gutter- or trough-shaped layer 6 takes place in the following way: In the showering zone Z1 (shown in the right-hand portion $a_1$ of FIG. 1), the corresponding device of the supplying means delivers particles P of smokable material against the underside of the lower reach of an endless foraminous belt conveyor 16 which forms part of the body of the transporting unit 4 and accumulates the thus supplied particles into the web 7. As can be seen in the right-hand portion of FIG. 1, the thickness of the web 7 is a relatively small fraction of the width of the conveyor 16. The upper side of the conveyor 16 is adjacent to a suction chamber 34 (see FIG. 3) which establishes a pressure differential of sufficient intensity to attract the particles P of the web 7 to the underside of the conveyor 16. The particles which are to form the web 7 are delivered along a surface 17.1 (FIGS. 1 and 3) which is inclined with reference to the longitudinal direction of the lower reach of the conveyor 16, and such particles form a thin stream which is advanced in a gaseous carrier medium, namely a stream of compressed air supplied by a nozzle 57 which is shown in FIG. 3. The upper part of the rightmost portion $a_1$ of FIG. 1 shows the corresponding section of the body of the transporting unit 4 from below, and it will be readily seen that the plane of the surface 17.1 and the direction (arrow 18) of advancement of the lower reach of the conveyor 16 make a relatively small acute angle. The lower part $a_2$ of the rightmost portion $a_1$ of the structure of FIG. 1 is shown in a transverse vertical sectional view, with the conveyor 16 located above the web 7 and surface 17.1, the same as in the apparatus which makes the layer 6.

The body of the transporting unit 4 further comprises two stationary sidewalls 19 and 21 which flank the marginal portions of the lower reach of the conveyor 16 and extend downwardly therefrom (as can be seen in the lower parts $b_2$ and $c_2$ of the corresponding portions $b_1$ and $c_1$ of FIG. 1). The sidewall 19 is outwardly adjacent to the leg 8 which is formed, subsequent to completion of formation of the web 7, from tobacco particles P showered in the zone Z2 by the corresponding device of the particle supplying means, and the sidewall 21 is outwardly adjacent to the leg 9 which is obtained from particles P showered in the zone Z3 by the corresponding device of the supplying means. The supplying means has a surface 17.2 which guides a thin stream of tobacco particles in the zone Z2 toward the inner side of the stationary sidewall 19, and a surface 17.3 which supplies a thin stream of particles P against the inner side of the stationary sidewall 21 in order to form the leg 9. The surfaces 17.2 and 17.3 extend in parallelism with the direction (arrow 18) of movement of the lower reach of the foraminous belt conveyor 16. The formation of the trough-shaped layer 6 is completed in the zone Z3, and the layer 6 is then converted into the filler 12 during passage through the zone Z4 of FIG. 1. The portion $d_1$ of FIG. 1 shows the corresponding section of the apparatus from below, and the part $d_2$ is a transverse vertical sectional view of the apparatus in the portion $d_1$. The trimming or equalizing device 26 further comprises a paddle wheel 28 (which can be replaced by a rotating brush or the like) which serves to remove from the layer 6 all such particles (shown at 27) which extend downwardly beyond the common plane of the disc-shaped members 11, i.e., in a direction away from the web 6 and transporting unit 4. The means for driving the shafts of the disc-shaped members 11 at a speed such that the peripheral speed of the members 11 matches or approximates the speed of the lower reach of the conveyor 16 is not specifically shown in the drawing. Reference may be had to commonly owned U.S. Pat. No. 4,538,626 granted Sept. 3, 1985 to Alfred Hinzmann which discloses a suitable tobacco trimming or equalizing device.

The marginal portions of the disc-shaped members 11 engage the adjacent portions of the legs 8, 9 of the layer 6 and move them nearer to each other so as to convert the layer 6 into the outer layer or shell 3 of the thus obtained rod-like filler 12. The relatively few particles P which are disposed in the interior of such outer layer 3 form the soft core or central portion 2 of the filler 12.

Figure 2:
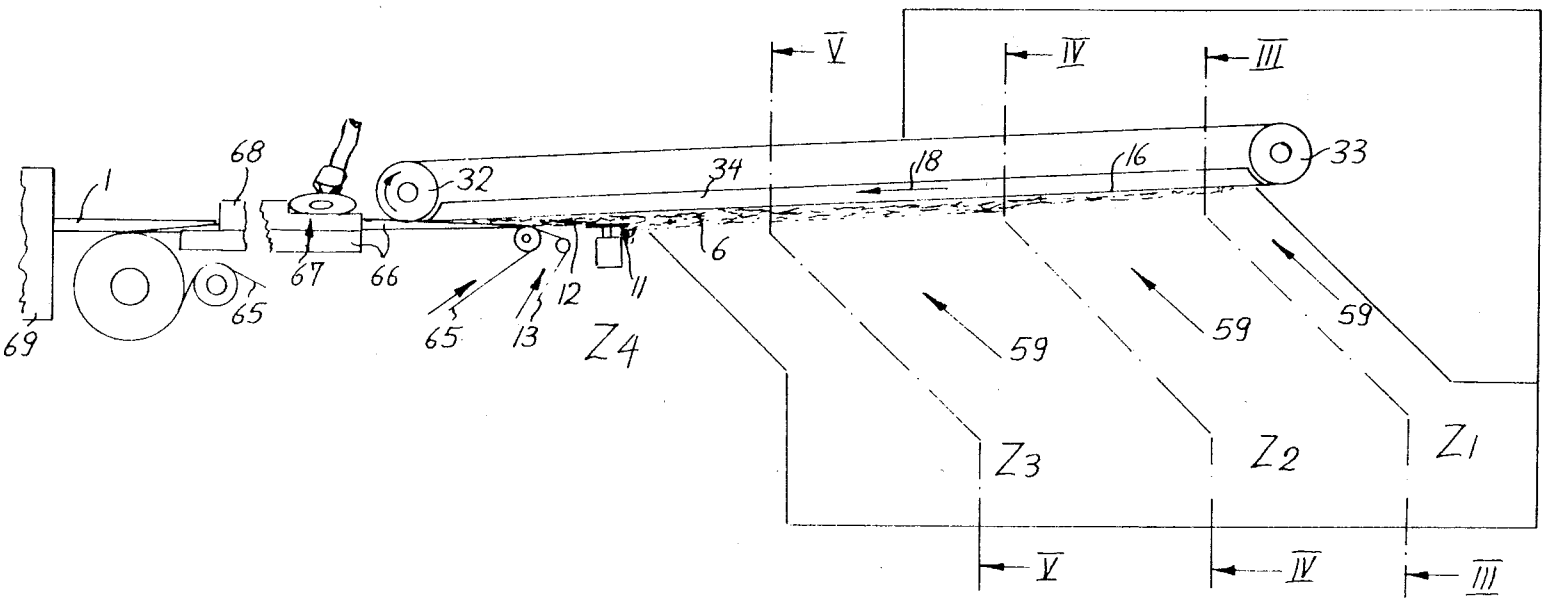
FIG. 2 is a schematic longitudinal sectional view of the machine which embodies the structure of FIG. 1, further showing the details of means for densifying the rod-like filler and for draping the densified filler into a web of wrapping material prior to subdivision into discrete rod-shaped articles.
Figure 4:
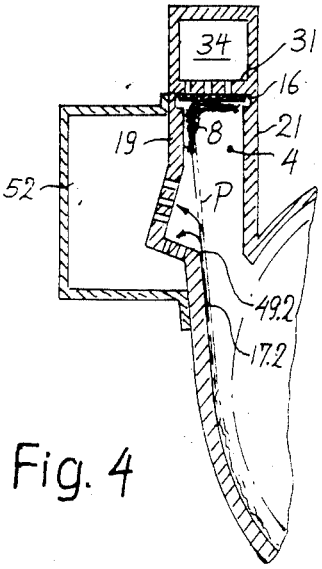
FIG. 4 is an enlarged fragmentary transverse sectional view as seen in the direction of arrows from the line IV—IV of FIG. 2.
Figure 5:
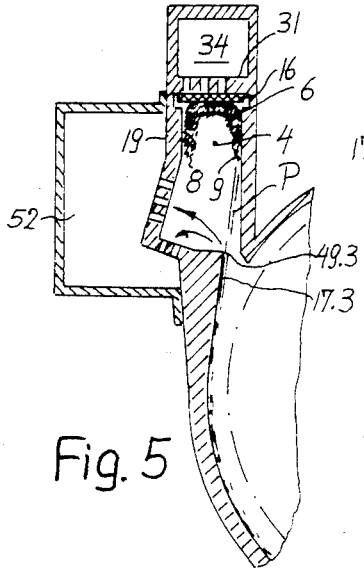
FIG. 5 is an enlarged fragmentary transverse sectional view as seen in the direction of arrows from the line V—V of FIG. 2.

FIGS. 2 to 5 illustrate in greater detail the construction and mode of operation of the transporting unit 4 and means for supplying particles P of smokable material into the path which is defined by the unit 4 so as to form the trough-shaped layer 6. More specifically, FIGS. 3, 4 and 5 show the details of the devices which form part of the supplying means and are operative in the zones Z1, Z2 and Z3 to form the web 7, the leg 8 and the leg 9 of the layer 6. The particle supplying means can form part of or it may receive particles P (e.g., tobacco shreds) from a distributor of the type disclosed in commonly owned U.S. Pat. No. 4,185,644 granted Jan. 29, 1980 to Uwe Heitmann et al. As explained above, the particles P are supplied first to the underside of the lower reach of the foraminous belt conveyor 16. The upper side of the lower reach of the conveyor 16 is adjacent to the perforated bottom wall 31 of the stationary suction chamber 34 which is connected with the intake of a suction generating device 36 (e.g., a fan or a pump) by a suction pipe 35. The conveyor 16 is trained over pulleys 32 and 33 which are shown in FIG. 2 and one of which is driven so as to advance the lower reach of the conveyor 16 in the direction of arrow 18.

As can be seen in the right-hand portion of FIG. 3, the particle supplying means comprises a funnel 37 having walls 38 and 39 which direct the supplied particles P into the range of the orbiting tips of pins 43 forming part of a wheel 42 which is driven at a constant speed to rotate in the direction of arrow 41 and to entrain the particles toward and beyond a step 44 which is formed at the lower end of the wall 38. The center of curvature of the lower portion of the wall 38 is located on the axis of the wheel 42. The particles P which have advanced beyond the step 44 travel along the concave inner side of a further wall 46 which has the aforediscussed surfaces 17.1, 17.2 and 17.3 in the zones Z1, Z2 and Z3, respectively. The center of curvature of that portion of the internal surface of the wall 46 which is located between the step 44 and the surfaces 17.1, 17.2, 17.3 is also disposed on the axis of the wheel 42. The upper end portion **46*a* of the wall 46 extends abruptly to the left, as viewed in FIG. 3, to enable the surface 17.1 to form a propelling edge 49.1 for the particles P which are to form the web 7 of the layer 6. The walls 38, 39 and 46 together form a guide 48 along which the particles P advance from the inlet of the funnel 37 into the path which is defined by the body of the transporting unit 4** in the zones Z1, Z2 and Z3.

The stationary sidewall 21 of the transporting unit 4 merges into an arcuate wall 51 which is adjacent to the upper portion of the wheel 42 and extends all the way to the wall 39 of the funnel 37. The center of curvature of the concave inner side of the wall 51 is located on the axis of the wheel 42.

The stationary sidewall 19 has an offset or inclined lower portion **19*a* which is connected to the upper end portion 46*a* of the wall 46. The wall portions 19*a*, 46*a* have holes or bores 53 which establish communication between the space which is bounded by the lower reach of the conveyor 16 and the sidewalls 19, 21 on the one hand and a suction chamber 52 on the other hand. The outlet of the suction chamber 52 is connected with the suction intake of a fan or suction pump 56 by a pipe 54**.

The aforementioned nozzle 57 extends along the zones Z1, Z2 and Z3 (as considered in the direction of arrow 18) and its walls 58 converge in a direction toward the step 44 to discharge a thin stream of compressed air which flows along the concave inner side of the wall 46 and transports the particles P at an elevated speed toward, along and beyond the surfaces 17.1, 17.2 and 17.3. The stream of air which issues from the nozzle 57 has a component of movement in the direction of the arrow 18. The direction of flow of compressed air from the nozzle 57 along the wall 46 is indicated in FIG. 2 by the arrows 59. The inlet of the nozzle 57 is connected with a plenum chamber 61 which receives compressed air from a blower 63 via conduit 62.

The surfaces 17.1, 17.2 and 17.3 extend substantially tangentially of the adjacent portions of the wheel 42 and respectively direct the particles P toward the propelling edges 49.1, 49.2 and 49.3. The particles which advance beyond the edge 49.1 form the web 7, the particles which advance beyond the edge 49.2 form the leg 8, and the particles which advance beyond the edge 49.3 form the leg 9 of the layer 6. FIG. 3 shows that the surface 17.1 directs particles across the full width of the underside of the lower reach of the conveyor 16 to form a web 7 of constant or nearly constant thickness, i.e., the web 7 extends all the way between the sidewalls 19 and 21. Such building or formation of the web 7 takes place in the zone Z1. In the zone Z2, the surface 17.2 directs the particles P into the left-hand corner of the space between the conveyor 16 and sidewalls 19, 21 (FIG. 4) so that the particles deposit along the inner side of the sidewall 19 and form the leg 8 of the layer 6. In the zone Z3, the surface 17.3 directs the particles P into the right-hand corner of the space between the conveyor 16 and sidewalls 19, 21 (see FIG. 5) so that the particles which advance beyond the edge 49.3 form the leg 9 at the inner side of the sidewall 21.

The mode of operation of the machine which embodies the structure of FIGS. 1 to 5 is as follows:

The distributor delivers particles P into the funnel 37 wherein the particles slide along the concave side of the wall 38 and enter the range of the tips of pins 43 to be entrained in the direction of arrow 41 and into the thin stream of compressed air that issues from the nozzle 57 below the step 44. The stream of compressed air advances the particles along the surfaces 17.1, 17.2 and 17.3 of the wall 46 so that thin streams of particles are propelled beyond the respective edges 49.1, 49.2 and 49.3 to respectively form the web 7, the leg 8 and the leg 9 of the layer 6 in the space between the underside of the lower reach of the conveyor 16 and the stationary sidewalls 19, 21. The surfaces 17.1, 17.2, 17.3 are respectively located in the zones Z1, Z2, Z3 so that the formation of the web 7 begins ahead of the formation of the leg 8 and the formation of the leg 8 begins ahead of the formation of the leg 9. While it is possible to select a different sequence of forming the constituents of the layer 6, the just described sequence has been found to be quite satisfactory because it allows for predictable and continuous formation of a layer of predetermined dimensions and in a relatively small space. Moreover, the web 7 pulls the legs 8, 9 along the sidewalls 19, 21.

The major percentage of air which is supplied by the nozzle 57 is evacuated via holes 53 in the wall portions **19*a*, 46*a* and enters the suction chamber 52. This ensures that the space between the conveyor 16 and the sidewalls 19, 21 does not accumulate excessive quantities of air which could cause the generation of eddy currents and/or other turbulences to thus interfere with the formation of a satisfactory layer 6. The lateral offset of the wall portions 19*a* and 46*a* is desirable and advantageous because it reduces the likelihood of clogging of the holes 53 with particles of smokable material. The inertia of particles P which are propelled along the surfaces 17.1, 17.2 and 17.3 by the stream of compressed air issuing from the nozzle 57 is sufficiently high to ensure that the trajectories of such particles do not change at the propelling edges 49.1, 49.2 and 49.3 in spite of the fact that a high percentage of the carrier medium (air) is drawn laterally into the holes 53. The remaining portion of air which is supplied by the nozzle 57 passes through the foraminous belt conveyor 16 and thereupon through the bottom wall 31 of the suction chamber 34 to be evacuated by the suction generating device 36. Such air attracts the web 7 to the underside of the lower reach of the conveyor 16. The latter moves in the direction of arrow 18 and entrains not only the web 7 but also the legs 8 and 9 which are integral with the respective marginal portions of the web. This is due to the fact that the surface 17.1 ensures the formation of a web 7 which extends all the way between the sidewalls 19, 21 (see FIG. 3). The web 7 and the legs 8, 9** are relatively thin streams or strata of particles P.

FIG. 2 shows that the disc-shaped members 11 of the trimming device 26 are located in the zone Z4 downstream of the zone Z3 (as considered in the direction of arrow 18). As can be seen at $d_2$ in FIG. 1, the marginal portions of the members 11 bend the lower portions of the legs 8, 9 toward each other to convert the trough-shaped layer 6 into the tubular filler 12. The marginal portions of the members 11 engage the outer sides of the adjacent portions of the legs 8, 9 and the surplus 27 which extends downwardly beyond the common plane of the members 11 is removed by the paddle wheel 28.

The lower reach of the conveyor 16 delivers successive increments of the filler 12 onto successive increments of the web 13 of cigarette paper or other suitable wrapping material which is being drawn from a bobbin or another suitable source (not shown) and advances with the upper reach of an endless belt conveyor 65 which draws the web 13 as well as the filler 12 through the wrapping mechanism 66 wherein the filler is densified and its cross-sectional area thereupon matches or approximates that of the rod-shaped smokers' articles which are formed by the cutoff 69. As mentioned above, and as can be seen in FIG. 1 (at e), the density of the central portion 2 of the filler is less pronounced than the density of the outer layer 3, not only in the filler 12 which leaves the conveyor 16 but also in the filler of the continuous rod 1. The draping mechanism 66 causes the web 13 to surround the filler 12 in such a way that one marginal portion of the web extends away from the filler and is coated with adhesive by a paster 67. Such adhesive-coated marginal portion is thereupon folded over the other marginal portion of the web 13 to form therewith a seam which extends in parallelism with the axis of the rod 1 and is stabilized during travel past one or more heated sealers 68 in order to ensure that the seam remains intact during severing of the rod by the knife or knives of the cutoff 69. The conveyor 65 transports the web 13 and the filler 12 through the wrapping mechanism 66 as well as along the paster 67 and sealer 68.

Figure 6:
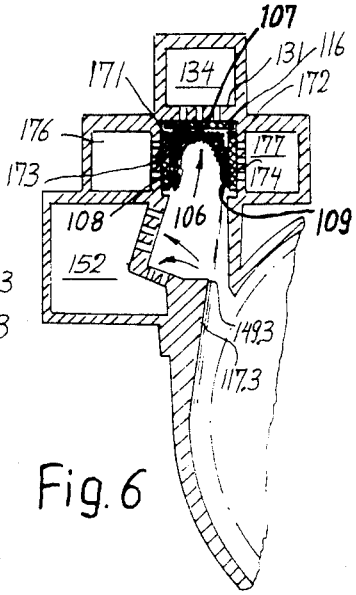
FIG. 6 is a fragmentary transverse sectional view of an apparatus which constitutes a modification of the apparatus of FIGS. 2 to 5.

FIG. 6 shows a modification of the apparatus of FIGS. 1 to 5. All such parts of the modified apparatus which are identical with or clearly analogous to the corresponding parts of the first apparatus are denoted by similar reference characters plus 100. The main difference between the apparatus of FIGS. 1–5 and 6 is that the stationary sidewalls 19, 21 of the first apparatus are replaced by additional foraminous belt conveyors 171, 172 which are respectively adjacent to the perforated walls 173, 174 of stationary suction chambers 176, 177 serving to ensure that the legs 108, 109 are pneumatically attracted to the inner sides of the inner reaches of the respective conveyors 171, 172. The apparatus of FIG. 6 exhibits the important advantage that the legs 108, 109 can never lag behind the web 107 of the layer 106 because the conveyors 171, 172 are driven at the speed of and in the same direction as the belt conveyor 116. On the other hand, the apparatus of FIGS. 1–5 is simpler and less expensive because it need not employ two additional foraminous belt conveyors and the means for guiding and driving such additional conveyors.

The additional conveyors 171, 172 need not necessarily be permeable to air. In other words, these conveyors can entrain the respective legs of the layer 106 by friction which is not enhanced by pneumatic attraction of such legs to the respective additional conveyors. The provision of suction chambers 176, 177 and air-permeable additional conveyors 171, 172 is preferred at this time because an apparatus which embodies such features is even more likely to transport the legs of the layer at the same speed as the web.

Figures 7, 8, 9:
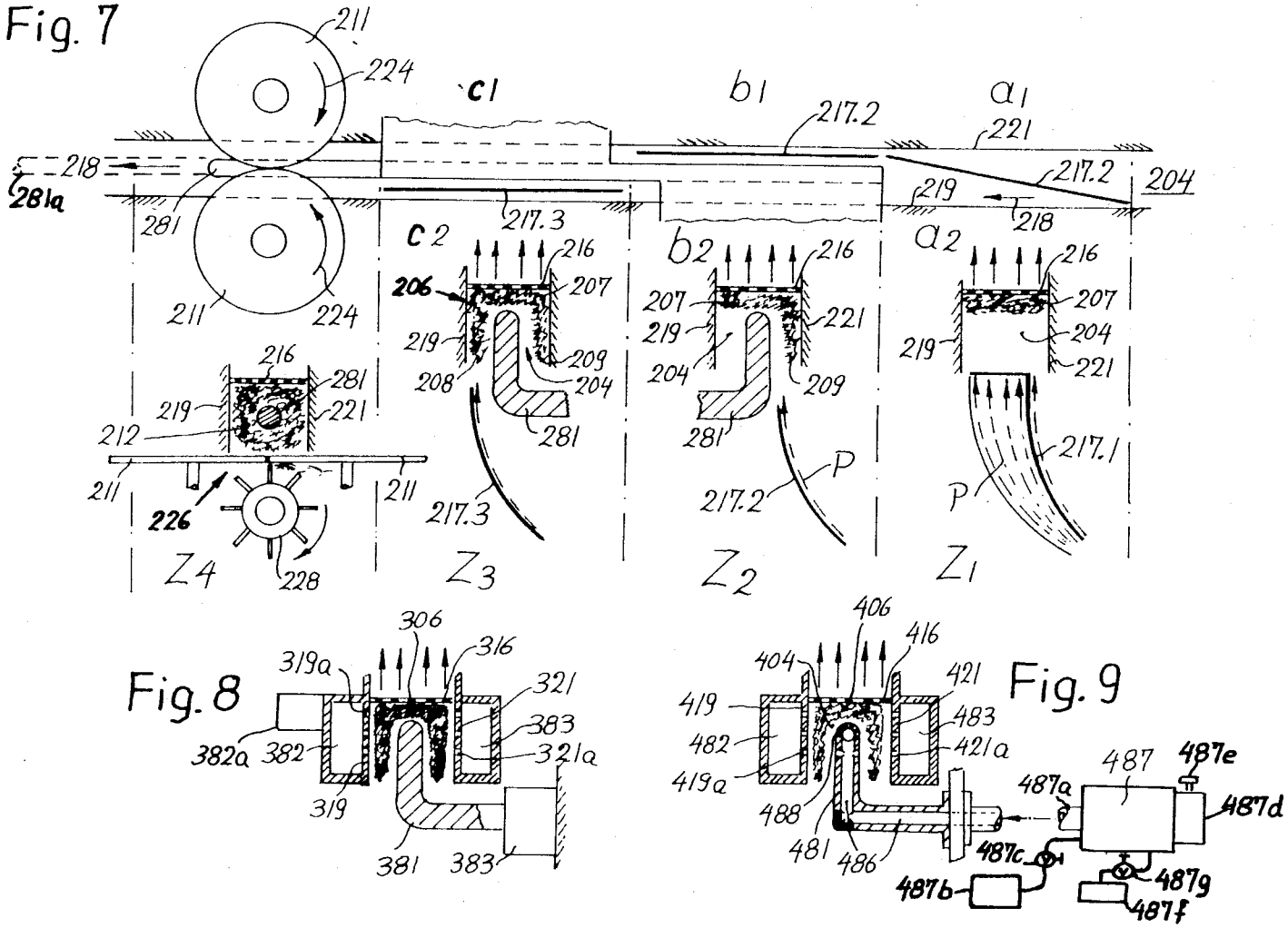
FIG. 7 is a diagrammatic bottom plan view of a portion of a cigarette rod making machine embodying a third apparatus which employs a stationary mandrel, four different stages of the making of a rod-like filler being shown in transverse sectional views below the corresponding portions of the apparatus.
FIG. 8 is a transverse sectional view of a portion of a fourth apparatus which constitutes a modification of the apparatus of FIG. 7.
FIG. 9 is a similar transverse sectional view of a portion of an apparatus which constitutes a second modification of the apparatus of FIG. 7.

FIG. 7 shows a third apparatus wherein all such parts which are identical with or clearly analogous to the corresponding parts of the apparatus of FIGS. 1 to 5 are denoted by similar reference characters plus 200. The apparatus of FIG. 7 comprises a stationary mandrel 281 which extends with clearance into the space between the lower reach of the conveyor 216 and sidewalls 219, 221 so as to provide room for the web 207 and legs 208, 209 of the trough-shaped layer 206 formed in the path which is defined by the transporting unit 204. The purpose of the mandrel 281 is to prevent penetration of particles P into the space between the underside of the web 207 and the inner sides of the legs 208, 209 during the formation of the layer 206 as well as during transport of the layer 206 toward the trimming or equalizing device 226. In fact, and as shown in FIG. 7, the tip of the mandrel 281 can extend beyond the nip of the discs 211 which form part of the device 226. Such positioning and such selection of the length of the mandrel 281 even more reliably ensure that the density of the central portion of the filler 212 is less pronounced than the density of the outer layer. In fact, the density of the central portion is zero, at least in those parts of the layer 206 and filler 212 which extend to and slightly beyond the trimming device 226.

FIG. 8 illustrates a first modification of the apparatus which is shown in FIG. 7. All such parts of this apparatus which are identical with or clearly analogous to the corresponding parts of the apparatus of FIG. 7 are denoted by similar reference characters plus 100. The stationary sidewalls 319, 321 of FIG. 8 are provided with openings or holes 319*a*, 321*a* which communicate with the plenum chambers 382, 383 constituting sources of compressed air and forming part of means for reducing friction between the mandrel 381 and the adjacent particles of the layer 306. The arrangement is preferably such that the jets of compressed air issuing from the holes 319*a*, 321*a* have components of movement in the direction of travel of the lower reach of the conveyor 316 so as to assist the conveyor 316 in advancing the layer 306 toward the trimming device. In addition to or in lieu of the friction reducing means in the form of plenum chambers 382 and 383, the apparatus of FIG. 8 can comprise friction reducing means in the form of a vibrator 383 which is attached to a stationary wall of the machine and which preferably vibrates the mandrel 381 at a frequency in the ultrasonic range. The vibrator 383 also vibrates the stationary sidewalls 319, 321. Alternatively, the sidewalls 319, 321 can be vibrated by one or two additional vibrators one of which is shown at 382*a*.

FIG. 9 shows a portion of an apparatus which constitutes a modification of the apparatus of FIG. 8. All such parts which are identical with those of the apparatus of FIG. 8 are denoted by similar reference characters plus 100. The friction reducing means includes the plenum chambers 482, 483 as well as a source 487 of compressed air which is connected to the mandrel 481 by a conduit 487*a* serving to admit compressed air into the channel 486 which is machined into the mandrel 481. The latter has ports 488 or analogous air discharging openings which admit air into the space between the lower reach of the belt conveyor 416 and the stationary sidewalls 419, 421 of the transporting unit 404. The jets of air issuing from the ports 488 reduce friction between the external surface of the mandrel 481 and the adjacent particles of the layer 406.

FIG. 9 further shows a source 487*b* of one or more volatile flavoring agents for the particles of the layer 406. The source 487*b* is connected with the source 487 by a conduit containing a combined shutoff and flow regulating valve 487*c* which can be manipulated by hand or by remote control and serves to regulate the rate of admission of flavoring agent or agents into the layer 406. An important advantage of the source 487*b* is that the volatile flavoring agent or agents are admitted into the layer 406 immediately prior to draping of this layer (actually of the filler which is obtained from the layer 406) into a web of cigarette paper or the like so that the flavoring agents cannot escape. Heretofore, flavoring agents were admitted into tobacco subsequent to shredding and prior to admission into the distributor so that a high percentage of often highly volatile flavoring agents was free to escape prior to draping. The arrangement of FIG. 9 brings about pronounced savings in flavoring agents and it also renders the atmosphere more bearable to attendants, especially if the flavoring agents are of the type which can be irritating to the attendants.

The apparatus of FIG. 9 further comprises a device 487*d* which constitutes a heater for compressed air and is adjustable by a knob 487*e* or the like. The admission of heated air into the layer 406 is desirable and advantageous because this further reduces friction between the layer and the mandrel 481. Moreover, heated air is often a more satisfactory carrier of flavoring agents into contact with the particles of the stream 406.

The source 487 of compressed air is further connected with a source 487*f* of moisture which is admitted by way of a conduit containing a combined shutoff and regulating valve 487*g*. The rate of admission of moisture is preferably selected in such a way that air issuing from the ports 488 of the mandrel 481 delivers moisture only to the particles which are immediately adjacent to the mandrel but not to the particles which are remote from the mandrel, i.e., not to those particles which are adjacent to the underside of the lower reach of the conveyor 416 and to the inner sides of the sidewalls 419, 421. The source 487*f* can contain water vapors or an atomizing device for water. Moisturizing of particles which are immediately adjacent to the mandrel 481 is often desirable and advantageous because this contributes to greater mobility of such particles relative to each other during conversion of the layer 406 into a tubular or annular filler with a dense outer layer and a less dense central portion. In other words, the admission of moisture to particles which are adjacent to the mandrel 481 promotes a predictable densification of the layer 406.

It goes without saying that the plenum chambers 382, 383 and/or 482, 483 can also be connected or combined with means for heating the gaseous fluid, with means for admitting volatile or other flavoring agents to the gaseous fluid and even with means for admitting moisture to the gaseous fluid if it becomes advisable or necessary to increase the moisture content of particles which form the outer layer of the filler.

In accordance with a modification which is indicated in FIG. 7, the mandrel can extend well beyond the trimming device and all the way to or into the wrapping mechanism, such as the wrapping mechanism 66 of FIG. 2. This is indicated in FIG. 7 by broken lines, as at 281*a*. The part 281*a* can constitute a detachable extension of the mandrel 281.

The provision of means 487*b*, 487*c*, 487, 487*a* for admitting volatile or other flavoring agents into the layer 406 by way of a hollow mandrel constitutes a highly advantageous and desirable feature of the improved apparatus. Conventional spraying or showering of flavoring agents onto tobacco shreds in or ahead of the distributor entails considerable losses in such agents prior to draping of the filler into a web of cigarette paper or the like. Such losses are eliminated or reduced to a minute fraction of the heretofore incurred losses by the provision of means for admitting one or more flavoring agents by way of the mandrel, i.e., into the layer 406, or into the filler which is obtained from such layer, immediately ahead of the draping mechanism.

The heater 487*d* can be designed and/or adjusted to raise the temperature of air in the source 487 from room temperature (approximately 20° C.) to a temperature in the range of 40° C. It has been found that this expedient of heating air which is admitted into the layer 406 or adjacent to the layer 406 via mandrel 481 (a) significantly reduces friction between the external surface of the mandrel and the adjacent particles of the layer, (b) enhances the penetration of flavoring agent or agents into the particles of the layer 406 and (c) promotes relative movement of certain particles during densification of the layer 406 to convert it into the filler of a wrapped tobacco rod. Such heating of air which enters the layer 406 via mandrel 481 and/or sidewalls 419, 421 is also considered to constitute a novel feature which warrants independent patent protection, the same as the admission of flavoring agent or agents via mandrel 481 and/or sidewalls 419, 421.

As a rule, moistening of those particles of the tobacco layer 406 which are immediately adjacent to the inner sides of the stationary sidewalls 419, 421 is not desirable because the admission of moisture to such particles would promote friction with the adjacent stationary sidewalls and would thus counteract the effect of heated or unheated air and/or vibrator means for the mandrel 481 and/or sidewalls 419, 421. Localized moistening of the layer 406 also constitutes a feature which is deemed novel and patentable independently of the other features of the improved method, apparatus and articles.

Figure 10:
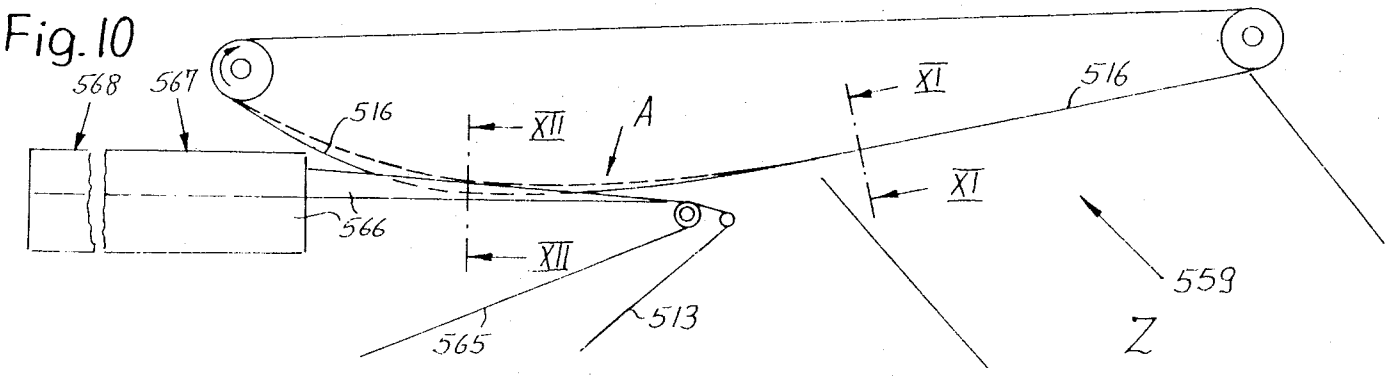
FIG. 10 is a schematic longitudinal sectional view of a portion of a cigarette rod making machine which embodies an additional apparatus.
Figure 11:
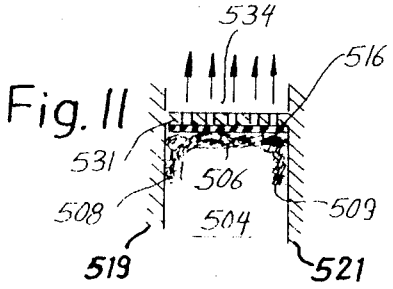
FIG. 11 is an enlarged fragmentary transverse sectional view as seen in the direction of arrows from the line XI—XI of FIG. 10.
Figure 12:
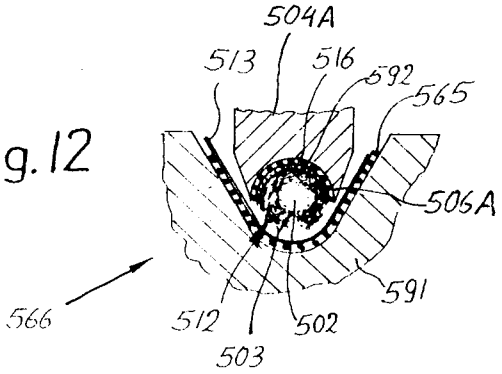
FIG. 12 is an enlarged fragmentary transverse sectional view as seen in the direction of arrows from the line XII—XII of FIG. 10.

FIGS. 10 to 12 illustrate an additional apparatus which can make a filler with a dense outer layer and a central portion of lesser density. The apparatus comprises a transporting unit 504 including an endless flexible foraminous belt conveyor 516 having a lower reach a portion of which advances along the upper region of a showering zone Z for delivery of particles of smokable material. As can be seen in FIG. 11, the particles which are delivered in the zone Z form a trough- or gutter-shaped layer 506 having a substantially U-shaped cross-sectional outline with a web which adheres to the conveyor 516 and two relatively narrow legs 508, 509 which extend downwardly from the respective marginal portions of the web 507. The arrow 559 indicates the direction of delivery of tobacco particles which are used to build the layer 506. The transporting unit 504 further includes sidewalls 519, 521 which are outwardly adjacent to the legs 508, 509 of the layer 506. The upper side of the lower reach of the conveyor 516 is adjacent to the perforated bottom wall 531 of a suction chamber 534 which is connected with a fan, not shown, or another suitable suction generating device. The transporting unit 504 also comprises a stationary deforming portion 504A which includes the gradually rising sidewalls and gradually arches the lower reach of the conveyor 516 in a manner as shown in FIG. 12 so that the layer 506 of U-shaped cross-sectional outline is converted into a concavo-convex second layer 506A which more closely resembles a gutter or trough in that it is bounded by truly convex and concave surfaces. Arching of the lower reach of the belt conveyor 516 begins ahead of a station or region A where successive increments of the second layer 506A are transferred onto successive increments of a complementarily arched web 513 of wrapping material. The suction chamber 534 terminates at the station A so as to facilitate the transfer of the layer 506A onto the web 513. The latter is drawn through the wrapping mechanism 566 and along the paster 567 and sealer 568 by an endless belt conveyor 565. The means for arching the web 513 so that the latter resembles a gutter not later than at the transfer station A comprises a suitably configurated bed 591 which engages the outer side of the web 513 between the bobbin (not shown) and the station A. A finger or mandrel 592 which is suitably curved is provided to separate the layer 506A from the concave side of the lower reach of the conveyor 516 at the station A. The finger or mandrel 592 can form part of the wrapping mechanism 566. This finger 592 can form part of or constitute the means for densifying the layer 406A in the mechanism 566 (in lieu of the belt 565) during conversion of such layer into the filler of a draped cigarette rod or the like. The marginal portions of the web 513 are bonded to each other downstream of the paster 567 but upstream of the sealer 588. The apparatus of FIGS. 10 to 12 also ensures the making of a filler 512 with a central portion or core 502 of lesser density and an outer layer 503 of greater density. Such ratio of densities remains at least substantially unchanged in the wrapped rod as well as in the rod-shaped articles which are obtained in response to repeated severing of the leader of such rod.

The various features of the improved apparatus can be used individually or jointly. For example, the mandrel 281 of FIG. 7 can be vibrated and/or used as a means for admitting dry air, heated dry air, moisturized air, heated and moisturized air or air which contains one or more flavoring agents. Also, the mandrel 481 of FIG. 9 can be vibrated, the same as the sidewalls 419, 421. Still further, the stationary sidewalls 19, 21 of the apparatus which is shown in FIGS. 1–5 can be used for admission of dry air, for admission of moist air, for admission of heated dry or moist air, for admission of one or more flavoring agents and/or as a means for vibrating the adjacent legs of the layer 6. Still further, the features of admitting dry, moist, heated and/or flavoring fluids by way of a mandrel or by way of sidewalls can be used in other types of apparatus for forming rod-shaped fillers, i.e., not only in apparatus wherein a layer of smokable particles is converted into a rod-like filler in a manner as described with reference to FIGS. 1 to 12.

The improved apparatus is susceptible of many additional modifications. For example, the devices which are shown in FIGS. 3, 4 and 5 for admission of particles P which form the web 7 and legs 8, 9 of the layer 6 can be replaced with other types of particle supplying devices without departing from the spirit of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of forming a rod-like filler from particles of smokable material, comprising the steps of accumulating the particles at one side of a flat elongated reach of a belt conveyor so that the particles form an elongated layer having a substantially U-shaped cross-sectional outline and a thickness which is a fraction of its width and including a web which overlies the one side of the reach and two legs which extend away from the one side of and are out of contact with the reach; advancing the layer and the reach lengthwise along a predetermined path and maintaining the legs of the layer out of contact with the reach; and converting the advancing layer into a filler having a central portion of lesser density and an outer layer of greater density.

2. The method of claim 1, wherein said accumulating step includes showering the particles into said path and pneumatically retaining the particles of said web in said path.

3. The method of claim 2, wherein said retaining step includes utilizing a foraminous belt conveyor and evacuating air from the other side of the reach in said path, said showering step including delivering particles to the one side of the reach in said path.

4. The method of claim 1, wherein said accumulating step further comprises first depositing particles at the ne side of the reach to form the web and thereupon depositing particles laterally adjacent to the reach to form the legs.

5. The method of claim 1, further comprising the step of transferring the rod-like filler onto a running web of wrapping material and draping the wrapping material around the filler.

6. The method of claim 5, further comprising the step of densifying the filler not later than in the course of said draping step.

7. Apparatus for forming a rod-like filler from particles of smokable material, comprising a transporting unit including an endless belt conveyor having a flat elongated reach defining an elongated path; means for supplying particles into a portion of said path so as to form at one side of said reach an elongated layer which has a substantially U-shaped cross-sectional outline, which advances lengthwise along said path, whose thickness is a fraction of the width thereof and which includes a web overlying the one side of said reach and two legs flanking the web and extending away from the one side of and being out of contact with said reach; and means for converting the layer in said path into a rod-like filler having a central portion of lesser density and an outer layer of greater density.

8. The apparatus of claim 7, wherein said conveyor is formainous and said reach has a second side facing away from said path, said transporting unit further comprising means for evacuating air from the second side of said reach, said supplying means including means for delivering particles to said one side of said reach.

9. A method of forming a rod-like filler from particles of smokable material, comprising the steps of accumulating the particles into an elongated layer having a thickness which is a fraction of its width, including establishing for the layer a trough-shaped transporting unit with a foraminous belt conveyor flanked at one side by two sidewalls and a suction chamber adjacent to the other side of the conveyor, and showering particles against the one side of the conveyor and the adjacent sidewalls to form on the transporting unit a layer having a substantially U-shaped cross-sectional outline; admitting at least one flavoring agent into the layer by way of the sidewalls of the transporting unit; advancing the layer lengthwise along a predetermiend path; and converting the advancing layer into a filler having a central portion of lesser density and an outer layer of greater density.

10. A method of forming a rod-like filler from particles of smokable material, comprising the steps of accumulating the particles into an elongated layer having a thickness which is a fraction of its width, including establishing for the layer a trough-shaped transporting unit with a foraminous belt conveyor flanked at one side by two sidewalls and a suction chamber adjacent to the other side of the conveyor, and showering particles against the one side of the conveyor and the adjacent sidewalls to form a layer having a U-shaped cross-sectional outline; admitting into the layer a hot gaseous fluid by way of the sidewalls; advancing the layer lengthwise along a predetermined path; and converting the advancing layer into a filler having a central portion of lesser density and an outer layer of greater density.

11. A method of forming a rod-like filler from particles of smokable material, comprising the steps of accumulating the particles into an elongated layer having a thickness which is a fraction of its width, including establishing for the layer a trough-shaped transporting unit with a foraminous belt conveyor flanked at one side by sidewalls and a suction chamber adjacent to the other side of the conveyor, and showering particles against the one side of the conveyor and against the sidewalls to form on the transporting unit a layer having a U-shaped cross-sectional outline; admitting moisture into the layer by way of the sidewalls in such quantities that the moisture contacts the particles at the adjacent side of the layer but not the particles at the opposite side; advancing the layer lengthwise along a predetermined path; and converting the advancing layer into a filler having a central portion of lesser density and an outer layer of greater density.

12. A method of forming a rod-like filler from particles of smokable material, comprising the steps of accumulating the particles into an elongated layer having a thickness which is a fraction of its width, including imparting to the layer a substantially U-shaped cross-sectional outline with a centrally located web and two legs flanking and extending from one side of the web; advancing the layer lengthwise along a predetermined path; converting the advancing layer into a filler having a central portion of lesser density and an outer layer of greater density, including moving the legs toward one another to transform the U-shaped layer into said rod-like filler; and preventing the penetration of particles into the space between the one side of the web and the legs of the layer prior to said converting step.

13. A method of forming a rod-like filler from particles of smokable material, comprising the steps of accumulating the particles into an elongated layer having a thickness which is a fraction of its width, including imparting to the layer a substantially U-shaped cross-sectional outline with a centrally located web and two legs flanking the web; advancing the layer lengthwise along a predetermined path, said imparting step including showering particles which form the web at an elevated speed and at an oblique angle to the direction of advancement of the layer along said path; and converting the advancing layer into a filler having a central portion of lesser density and an outer layer of greater density.

14. A method of forming a rod-like filler from particles of smokable material, comprising the steps of accumulating the particles into an elongated layer having a thickness which is a fraction of its width, including imparting to the layer a substantially U-shaped cross-sectional outline with a centrally located web and two legs flanking the web; advancing the layer lengthwise along a predetermined path, said imparting step including showering particles which form the legs at an elevated speed and in substantial parallelism with the direction of advancement of the layer along said path; and converting the advancing layer into a filler having a central portion of lesser density and an outer layer of greater density.

15. A method of forming a rod-like filler from particles of smokable material, comprising the steps of accumulating the particles into an elongated layer having a thickness which is a fraction of its width, including imparting to the layer a substantially U-shaped cross-sectional outline with a centrally located web and two legs flanking and extending from one side of the web; advancing the layer lengthwise along a predetermined path; and converting the advancing layer into a filler having a central portion of lesser density and an outer layer of greater density, including mechanically engaging those portions of the legs which are remote from the web and moving such portions nearer to each other so that the layer is converted into a substantially tubular body.

16. The method of claim 15, wherein said engaging step includes contacting the legs by two rotating discs and further comprising the step of removing the particles which extend beyond the discs in a direction away from the one side of the web.

17. A method of forming a rod-like filler from particles of smokable material, comprising the steps of accumulating the particles into an elongated first layer having a thickness which is a fraction of its width and having a U-shaped cross-sectional outline; converting the first layer into a concavo-convex trough-shaped second layer; advancing the second layer along a predetermined path; and converting the advancing second layer into a filler having a central portion of lesser density and an outer layer of greater density, including transferring the second layer onto a trough-shaped web of wrapping material, densifying the second layer in the web to impart it the cross-sectional outline of a rod-shaped smokers' article, and thereupon converting the web into a tubular envelope which completely surrounds the densified second layer.

18. Apparatus for forming a rod-like filler from particles of smokable material, comprising transporting unit defining an elongated path; means for supplying particles into a portion of said path so that the deposited particles immediately form an elongated layer which has several mutually inclined longitudinally extending portions and advances lengthwise along said path; and means for converting the layer in said path into a rod-like filler having a central portion of lesser density and an outer layer of greater density, including means for changing the configuration and mutual position of said longitudinally extending portions so that the cross-sectional outline of the densified filler resembles that of a rod-shaped smokers' article.

19. Apparatus for forming a rod-like filler from particles of smokable material, comprising a transporting unit defining an elongated path and including an elongated conveyor defining said path and having a substantially U-shaped cross-sectional outline with a concave side facing said path; means for supplying particles into a portion of said path so as to form an elongated layer which advances lengthwise along said path and whose thickness is a fraction of the width thereof, said supplying means including means for depositing particles at the concave side of the conveyor so that the thus obtained layer has a substantially U-shaped cross-sectional outline with a longitudinally extending web flanked by two legs having free marginal portions remote from the web; means for converting the layer in said path into a rod-like filler having a central portion of lesser density and an outer layer of greater density, including means for moving the marginal portions of the conveyor and hence the free marginal portions of the legs nearer to each other; a source of web-shaped wrapping material; means for advancing the wrapping material from said source into said path; means for draping the wrapping material around the layer which is delivered thereto by said conveyor; means for imparting to the wrapping material the shape of a trough not later than in the region of transfer of the layer onto such wrapping material; and means for densifying the draped layer including a stationary mandrel extending into the layer downstream of said region so that the cross-sectional outline of the densified layer resembles that of a rod-shaped smokers' article.

20. A method of forming a rod-like filler from particles of smokable material, comprising the steps of accumulating the particles at one side of a flat elongated reach of a belt conveyor so that the particles form an elongated layer having a substantially U-shaped cross-sectional outline and a thickness which is a fraction of its width and including a web which overlies the one side of the reach and two legs which extend away from the one side of the reach, comprising first depositing particles at the one side of the reach to form the web and thereupon depositing particles laterally adjacent to the reach to form the legs, said step of depositing particles laterally adjacent to the web including first depositing particles which form one of the legs and thereupon depositing particles which form the other of the legs; advancing the layer and the reach lengthwise along a predetermined path; and converting the advancing layer into a filler having a central portion of lesser density and an outer layer of greater density.

21. A method of forming a rod-like filler from particles of smokable material, comprising the steps of accumulating the particles at one side of a flat elongated reach of a belt conveyor so that the particles form an elongated layer having a substantially U-shaped cross-sectional outline and a thickness which is a fraction of its width and including a web which overlies the one side of the reach and two legs which extend away from the one side of the reach; advancing the layer and the reach lengthwise along a predetermined path; mechanically entraining the legs along said path; and converting the advancing layer into a filler having a central portion of lesser density and an outer layer of greater density.

22. The method of claim 21, wherein said entraining step includes placing a pair of foraminous conveyors along the two marginal portions of the reach and pneumatically holding the particles which form the legs on the foraminous conveyors.

23. A method of forming a rod-like filler from particles of smokable material, comprising the steps of accumulating the particles at one side of a flat elongated reach of a belt conveyor so that the particles form an elongated layer having a substantially U-shaped cross-sectional outline and a thickness which is a fraction of its width and including a web which overlies the one side of the reach and two legs which exend away from the one side of the reach; advancing the layer and the reach lengthwise along a predetermined path; entraining the legs of the layer along stationary sidewalls which extend beyond the one side of and flank the reach; and converting the advancing layer into a filler having a central portion of lesser density and an outer layer of greater density.

24. The method of claim 23, further comprising the step of reducing friction between the sidewalls and the legs of the layer in said path.

25. The method of claim 24, wherein said friction reducing step includes admitting a gaseous fluid between the sidewalls and the legs.

26. The method of claim 24, wherein said friction reducing step includes vibrating the sidewalls.

27. The method of claim 26, wherein said vibrating step includes vibrating the sidewalls at a frequency in the ultrasonic range.

28. A method of forming a rod-like filler from particles of smokable material, comprising the steps of accumulating the particles at one side of a flat elongated reach of a belt conveyor so that the particles form an elongated layer having a substantially U-shaped cross-sectional outline and a thickness which is a fraction of its width and including a web which overlies the one side of the reach and two legs which extend away from the one side of the reach; advancing the layer and the reach lengthwise along a predetermined path; preventing the penetration of particles into the space between the legs and the web; and converting the advancing layer into a filler having a central portion of lesser density and an outer layer of greater density.

29. The method of claim 28, wherein said preventing step includes positioning a mandrel adjacent to said path so that the mandrel at least substantially fills said space.

30. The method of claim 29, further comprising the step of reducing friction between the mandrel and the particles of the layer, including introducing a gaseous fluid between the mandrel and the layer.

31. The method of claim 29, further comprising the step of reducing friction between the mandrel and the particles of the layer, including vibrating the mandrel.

32. The method of claim 31, wherein said vibrating step includes vibrating the mandrel at a frequency in the ultrasonic range.

33. The method of claim 29, further comprising the step of admitting into the layer at least one flavoring agent by way of the mandrel.

34. The method of claim 29, further comprising the step of admitting into the layer a hot gaseous fluid by way of the mandrel.

35. The method of claim 29, further comprising the step of admitting moisture into the layer by way of the mandrel in such quantities that the moisture comes into contact with particles at the adjacent side of the layer but not with the particles at the opposite side.

36. Apparatus for forming a rod-like filler from particles of smokable material, comprising a transporting unit including an endless belt conveyor having a flat elongated reach defining an elongated path; means for supplying particles into a portion of said path so as to form at one side of said reach an elongated layer which has a substantially U-shaped cross-sectional outline, which advances lengthwise along said path, whose thickness is fraction of the width thereof and which includes a web overlying the one side of said reach and two legs flanking the web and extending away from the one side of said reach, said transporting unit including a substantially trough-shaped body surrounding three sides of said path and said supplying means including means for delivering particles to such three sides of said path; and means for converting the layer in said path into a rod-like filler having a central portion of lesser density and an outer layer of greater density.

37. The apparatus of claim 36, wherein said body includes said belt conveyor and said conveyor is foraminous, said transporting unit further comprising a suction chamber adjacent to the other side of said reach.

38. The apparatus of claim 37, wherein said supplying means includes a first device which delivers particles to form the web and at least one second device which delivers particles to form the legs of the layer in said path.

39. The apparatus of claim 37, wherein said supplying means includes a first device which delivers particles to form the web, a second device which delivers particles to form one of the legs, and a third device which delivers particles to form the other leg of the layer in said path.

40. The apparatus of claim 37, wherein said body further includes two additional belt conveyors which flank and extend beyond the one side of said reach.

41. The apparatus of claim 40, wherein said additional conveyors are permeable to air and said body includes additional suction chambers outwardly adjacent to said additional conveyors so as to attract the legs of the layer against the respective additional conveyors.

42. The apparatus of claim 37, wherein said body further comprises two stationary sidewalls flanking and extending beyond the one side of said reach.

43. The apparatus of claim 42, further comprising means for reducing friction between said sidewalls and the respective legs of the layer in said path.

44. The apparatus of claim 43, wherein said friction reducing means includes at least one source of compressed gaseous fluid and said sidewalls have openings connected to said source and arranged to admit gaseous fluid between said sidewalls and the adjacent legs of the layer in said path.

45. The apparatus of claim 43, wherein said friction reducing means comprises means for vibrating said sidewalls.

46. The apparatus of claim 45, wherein said vibrating means includes means for vibrating said sidewalls at a frequency in the ultrasonic range.

47. The apparatus of claim 42, further comprising at least one source of flavoring agent for the particles of smokable material and means for admitting such flavoring agent into the particles of the layer in said path by way of said sidewalls.

48. The apparatus of claim 42, further comprising a source of heated gaseous fluid and means for admitting such fluid into the layer in said path by way of said sidewalls.

49. The apparatus of claim 42, further comprising a source of moisturized gaseous fluid and means for admitting such fluid into the layer in said path by way of said sidewalls at such a rate that the moisture contacts the particles at that side of said layer which faces the three sides of said path but not the particles at the opposite side of the layer.

50. The apparatus of claim 37, further comprising a stationary mandrel disposed between and spaced apart from said three sides of said path.

51. The apparatus of claim 50, further comprising means for reducing friction between the layer and the mandrel.

52. The apparatus of claim 51, wherein said friction reducing means comprises a source of compressed gaseous fluid and said mandrel has openings connected to said source and arranged to admit gaseous fluid between the layer and the external surface of the mandrel.

53. The apparatus of claim 51, wherein said friction reducing means comprises means for vibrating said mandrel.

54. The apparatus of claim 53, wherein said vibrating means comprises means for vibrating said mandrel at a frequency in the ultrasonic range.

55. The apparatus of claim 50, further comprising at least one source of flavoring agent for the particles of smokable material and means for admitting such flavoring agent into the particles of the layer by way of said mandrel.

56. The apparatus of claim 50, further comprising a source of heated gaseous fluid and means for admitting such gaseous fluid into the layer by way of said mandrel.

57. The apparatus of claim 50, further comprising a source of moisturized gaseous fluid and means for admitting such fluid into the layer in said path by way of said mandrel at a rate such that the moisturized fluid contacts the particles which are immediately adjacent to the mandrel but not the particles which are remote from the mandrel.

58. The apparatus of claim 50, wherein said converting means comprises means for draping the rod-like filler into a web of wrapping material and said mandrel terminates in the region of said draping means.

59. The apparatus of claim 36, wherein said converting means comprises mobile deforming means arranged to engage portions of the legs at a location which is remote from the web of the layer in said path and to move such portions of the legs nearer to each other.

60. The apparatus of claim 59 wherein said deforming means comprises two rotary discs.

61. The apparatus of claim 60, further comprising means for removing from the layer those particles which extend beyond the discs in a direction away from the web of the layer in said path.

* * * * *